US006894235B2

(12) United States Patent
Mihara

(10) Patent No.: US 6,894,235 B2
(45) Date of Patent: May 17, 2005

(54) SLIDING SWITCH WITH LUBRICANT AND METHOD FOR MANUFACTURING THE SAME

(75) Inventor: Haruhiko Mihara, Tsu (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 10/179,886

(22) Filed: Jun. 26, 2002

(65) Prior Publication Data

US 2003/0010612 A1 Jan. 16, 2003

(30) Foreign Application Priority Data

Jun. 26, 2001 (JP) ..... 2001-193795

(51) Int. Cl.[7] ..... H01H 9/30
(52) U.S. Cl. ..... 200/11 R; 200/336
(58) Field of Search ..... 200/11 R, 19.18, 200/19.21, 336, 14, 11 A, 11 C, 11 DA, 19.07; 338/160, 161, 162

(56) References Cited

U.S. PATENT DOCUMENTS 2,169,594 A * 8/1939 Schellenger ..... 29/620
2,827,536 A * 3/1958 Moore et al. ..... 29/620
2,876,320 A * 3/1959 Blaustein ..... 338/162
3,758,733 A * 9/1973 DuRocher et al. ..... 200/82 R
4,590,344 A * 5/1986 Kikta et al. ..... 200/291
5,554,965 A * 9/1996 Sundberg ..... 338/160
5,811,747 A * 9/1998 Taniguchi et al. ..... 200/61.88
6,142,018 A * 11/2000 Dedert et al. ..... 73/305
6,359,545 B1 * 3/2002 Bressers ..... 338/160

FOREIGN PATENT DOCUMENTS

| | | |
|---|---|---|
| JP | S 61-44741 | 3/1986 |
| JP | H 2-14617 | 1/1990 |
| JP | 3-283211 | 12/1991 |
| JP | 2000-188028 | 7/2000 |

* cited by examiner

*Primary Examiner*—K. Lee
(74) *Attorney, Agent, or Firm*—Oblon, Spivak, McClelland, Maier & Neustadt, P.C.

(57) ABSTRACT

A switch includes a movable contact slidable on a stationary contact and configured to be electrically connected to and disconnected from the at least one stationary contact. Lubricant is provided between the stationary contact and the movable contact. The stationary contact has a contact surface which is configured to contact the movable contact. The contact surface is rough to retain the lubricant thereon and to be electrically connected to the movable contact.

15 Claims, 18 Drawing Sheets

21A
22a1
37A
37C
22c1
16A
2
31c
37
2d
23a1
37B
38
23c1
21B
16B 38
16A
22a1
37E
37A
37C
37
2d
31c
2
37B
23a1
38
21B
16B
37E
SD 2A
3A
3A
(1)
2A
41A
42A
30b
36
30
33
34
12
30a
1A
36
11
42A
30b
16A
4
5

2A
3A
(1)
(2)
3A
19
4
20
3
35b
20
12
35a
27
35b
2
1B
41B
16B

SLIDING SWITCH WITH LUBRICANT AND METHOD FOR MANUFACTURING THE SAME

CROSS-REFERENCE TO RELATED APPLICATIONS

The present application claims priority to Japanese Patent Application No.2001-193795, filed Jun. 26, 2001. The contents of that application are incorporated herein by reference in their entirety.

BACKGROUND OF THE INVENTION

1. Field of the Invention

The present invention relates to a sliding switch and a method for manufacturing the sliding switch.

2. Discussion of the Background

Generally, a sliding switch includes a stationary contact and a movable contact which is slidable on the stationary contact and which is electrically connected to and disconnected from the stationary contact.

In this sliding switch, since the movable contact slides on a contact surface of the stationary contact, an electric conductor which forms the stationary contact is worn away and produce metal powders.

SUMMARY OF THE INVENTION

According to one aspect of the present invention, a switch includes at least one stationary contact and at least one movable contact slidable on the at least one stationary contact. The movable contact is configured to be electrically connected to and disconnected from the at least one stationary contact. Lubricant is provided between the at least one stationary contact and the at least one movable contact. The at least one stationary contact has a contact surface which is configured to contact the at least one movable contact. The contact surface is rough to retain the lubricant thereon and to be electrically connected to the at least one movable contact.

According to another aspect of the present invention, a method for manufacturing a switch includes providing at least one stationary contact and providing at least one movable contact to be slidable on the at least one stationary contact and to be electrically connected to and disconnected from said at least one stationary contact. Lubricant is provided between the at least one stationary contact and the movable contact. A contact surface is provided on the at least one stationary contact to be configured to contact the at least one movable contact. The contact surface is roughened to retain the lubricant thereon and to be electrically connected to the at least one movable contact.

According to further aspect of the present invention, a switch includes at least one stationary contact and at least one movable contact slidable on the at least one stationary contact. The movable contact is configured to be electrically connected to and disconnected from the at least one stationary contact. Lubricant is provided between the at least one stationary contact and the at least one movable contact. Either one of the at least one stationary contact or the at least one movable contact has a contact surface which is configured to contact another of the at least one stationary contact or the at least one movable contact. The contact surface is rough to retain the lubricant thereon and to be electrically connected to the another of the at least one stationary contact or the at least one movable contact.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2(*b*) is a side view of the rotary switch according to the embodiment of the present invention, seen from one side;

FIG. 2(*c*) is a lower surface view of the rotary switch according to the embodiment of the present invention;

FIG. 3(*b*) is an upper surface view of the rotary switch according to the embodiment of the present invention;

FIG. 4(*b*) is an inner side view of the first base block used in the rotary switch according to the embodiment of the present invention;

FIG. 5(*b*) is an outer side surface view of the first base block used in the rotary switch according to the embodiment of the present invention;

FIG. 5(*c*) is a lower surface view of the first base block used in the rotary switch according to the embodiment of the present invention, seen as the lower surface in FIGS. 5(*a*) to 5(*d*);

FIG. 5(*d*) is a horizontal sectional view of the first base block used in the rotary switch according to the embodiment of the present invention;

FIG. 6(*b*) is an outer surface side view of the second base block used in the rotary switch according to the embodiment of the present invention;

FIG. 7(*b*) is an inner surface side view of the second base block used in the rotary switch according to the embodiment of the present invention;

FIG. 7(*c*) is a lower surface view of the second base block used in the rotary switch according to the embodiment of the present invention, seen as the lower surface in FIGS. 7(*a*) to 7(*d*);

FIG. 7(*d*) is a horizontal sectional view of the second base block used in the rotary switch according to the embodiment of the present invention;

FIG. 8(*b*) is a side sectional view of one of the stationary contact sections used in the rotary switch according to the embodiment of the present invention;

FIG. 8(*c*) is a front view of one of the stationary contact sections used in the rotary switch according to the embodiment of the present invention, seen from the inner side;

FIG. 8(*d*) is a side view of one of the stationary contact sections used in the rotary switch according to the embodiment of the present invention;

FIG. 9(*b*) is a side sectional view of the other stationary contact section used in the rotary switch according to the embodiment of the present invention;

FIG. 9(*c*) is a front view of the other stationary contact section used in the rotary switch according to the embodiment of the present invention, seen from the inner side;

FIG. 9(*d*) is a side view of the other stationary contact section used in the rotary switch according to the embodiment of the present invention;

FIG. 10(*b*) is a side view of one of the operation handles used in the rotary switch according to the embodiment of the present invention, as seen from one side;

FIG. 10(*c*) is a lower surface view of one of the operation handles used in the rotary switch according to the embodiment of the present invention;

FIG. 10(*d*) is a side view of one of the operation handles used in the rotary switch according to the embodiment of the present invention, as seen from the other side;

FIG. 10(*e*) is a front view of one of the operation handles used in the rotary switch according to the embodiment of the present invention;

FIG. 11(*b*) is a front view of one of torsion springs used in the rotary switch according to the embodiment of the present invention;

FIG. 12(*b*) is a lower surface view of the other operation handle used in the rotary switch according to the embodiment of the present invention;

FIG. 12(*c*) is a side sectional view of the other operation handle used in the rotary switch according to the embodiment of the present invention;

FIG. 12(*d*) is a upper surface view of the other operation handle used in the rotary switch according to the embodiment of the present invention;

FIG. 12(*e*) is a front view of the other operation handle used in the rotary switch according to the embodiment of the present invention;

FIG. 13(*b*) is a front view of the other torsion spring used in the rotary switch according to the embodiment of the present invention;

DESCRIPTION OF THE EMBODIMENTS

Figure 1:
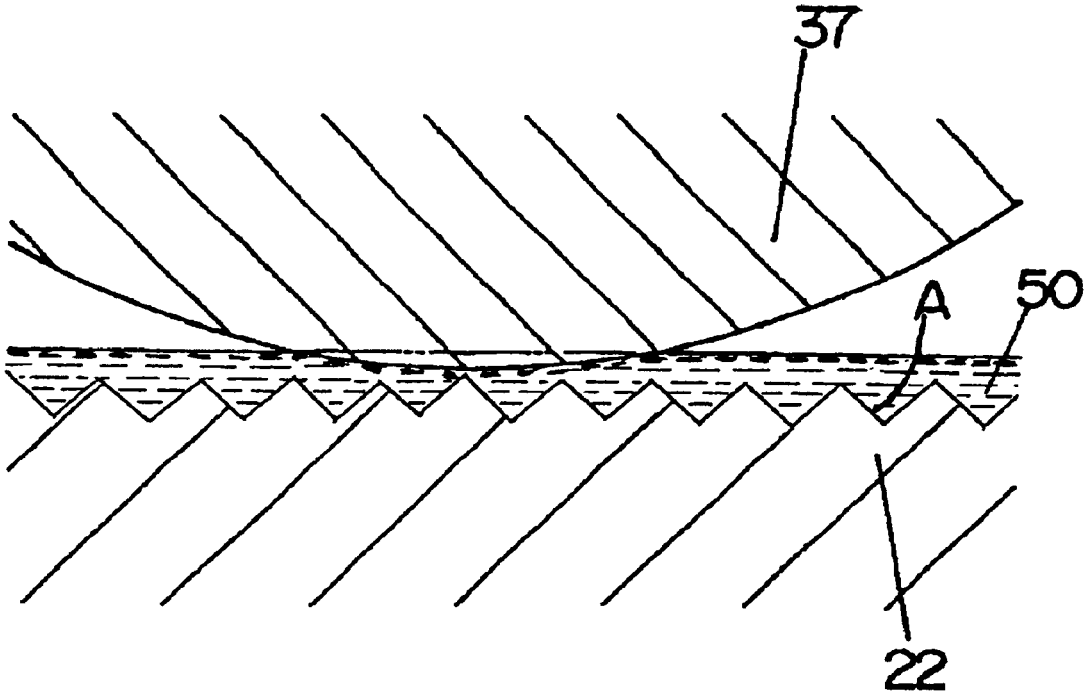
FIG. 1 is an enlarged, sectional view schematically showing a main part of a rotary switch according to an embodiment of the present invention.

The embodiments will now be described with reference to the accompanying drawings, wherein like reference numerals designate corresponding or identical elements throughout the various drawings.

Figure 2A:
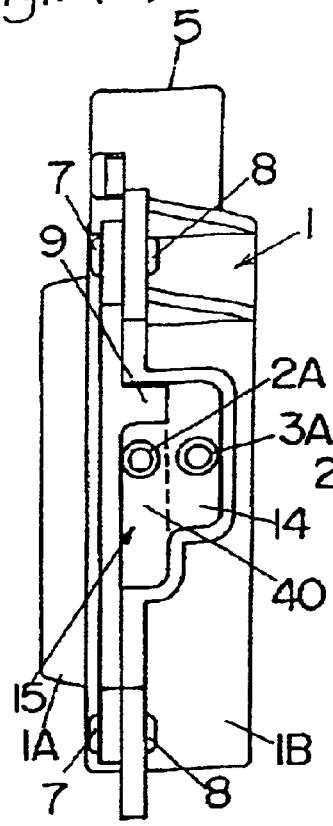
FIG. 2(*a*) is a front view of the rotary switch according to the embodiment of the present invention.
Figure 2B:
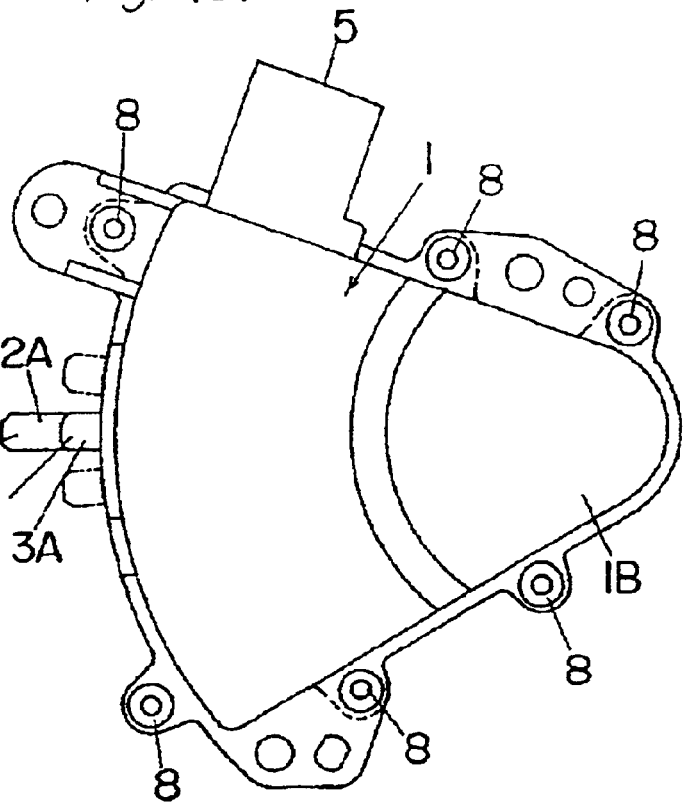
Figure 2C:
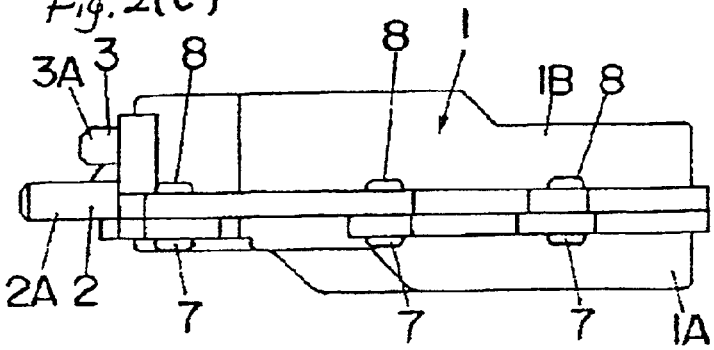
Figure 3A:
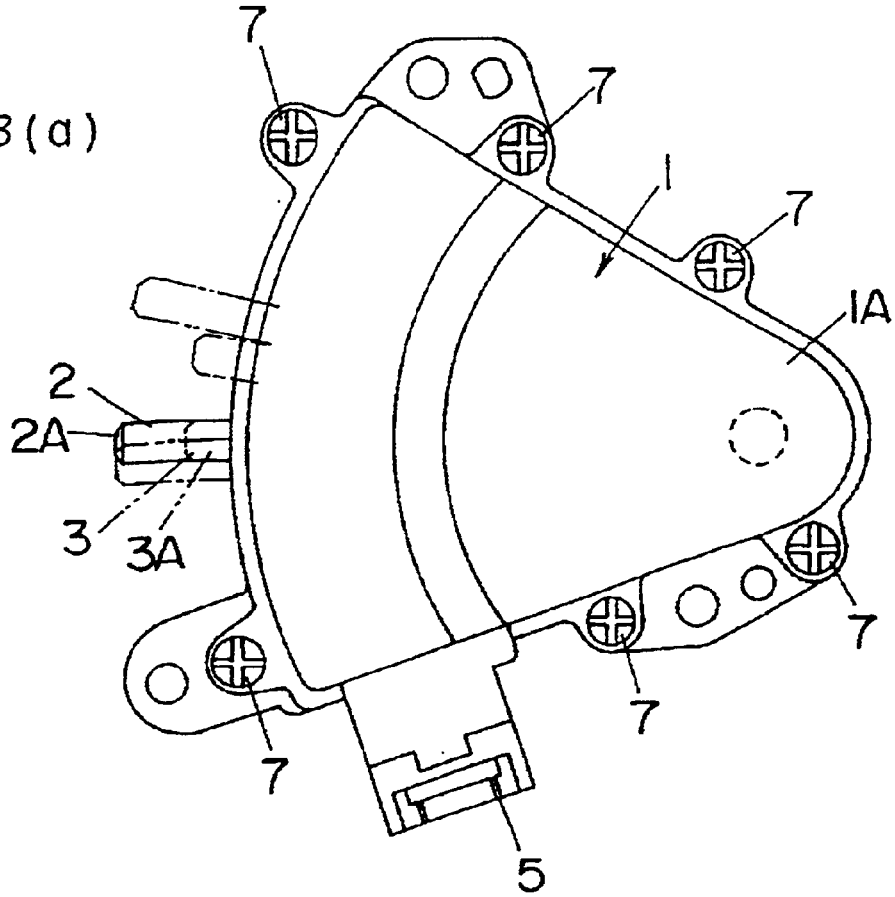
FIG. 3(*a*) is a side view of the rotary switch according to the embodiment of the present invention, seen from the other side.
Figure 3B:
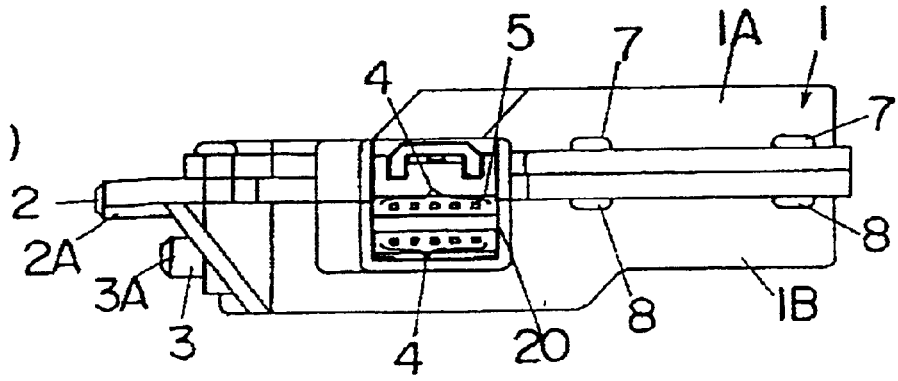

FIGS. 2(*a*)–2(*c*), FIGS. 3(*a*) and 3(*b*) show an appearance of a sliding switch according to an embodiment of the invention. The sliding switch includes a rotary switch and the like. In the present embodiment, a rotary switch is explained, for example. The rotary switch according to the embodiment of the invention includes an instrument body 1 having a substantially fan-like shape in a side view, and two operation handles 2, 3 are arranged in parallel in an inner space of the instrument body 1. Each one end of the operation handles 2, 3 is supported in the fan-shaped instrument body 1 to be freely rotatable around an axial support point. Then, operating sections (2A, 3A) of the operation handles 2, 3 are projected outside from an opening window 15 at an end surface of the instrument body 1, and the operating sections (2A, 3A) are coupled to, for example, an interlocking mechanism for interlocking with a mechanism section of a shift lever of an automobile.

One end portion of the instrument body 1 is provided with a connector section 5 including an output terminal group for outputting a switch signal to the outside.

Figure 4A:
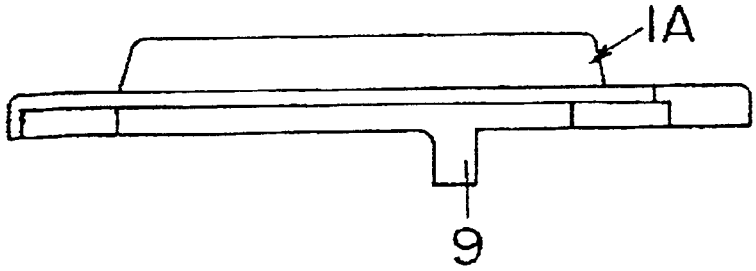
FIG. 4(*a*) is an upper surface view of a first base block used in the rotary switch according to the embodiment of the present invention.
Figure 4B:
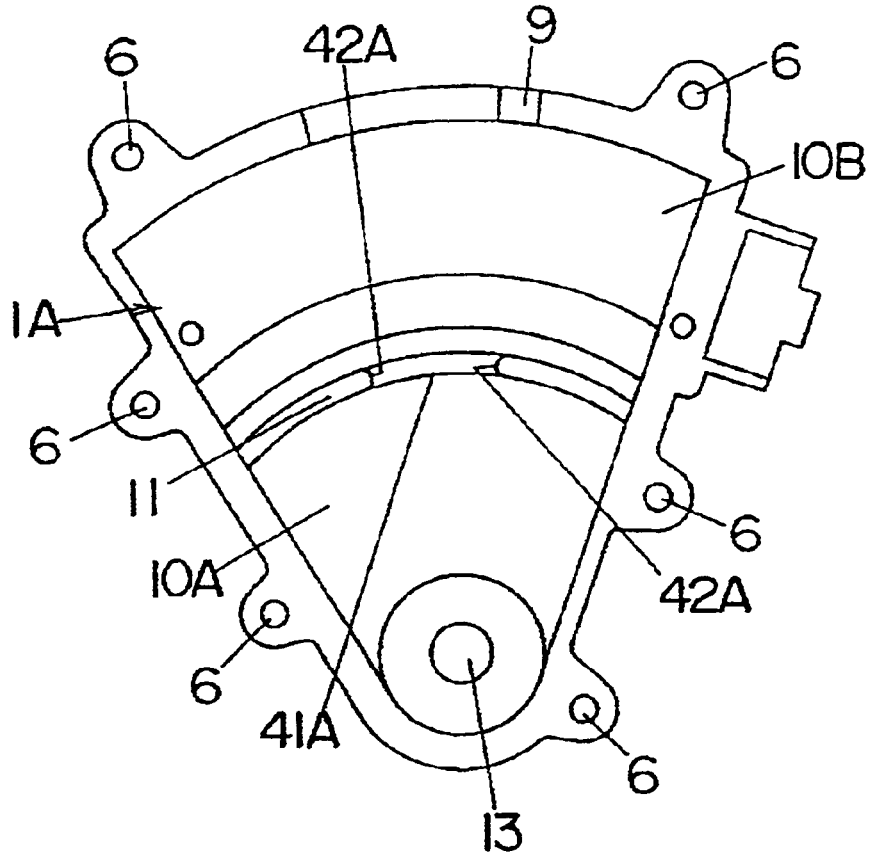
Figure 5:
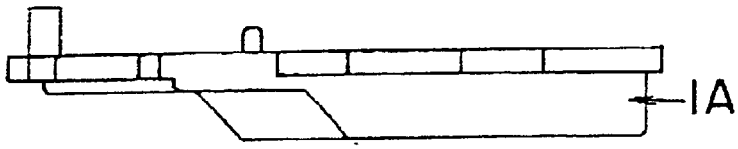
FIG. 5(*a*) is an upper surface view of the first base block used in the rotary switch according to the embodiment of the present invention, seen as the upper surface in FIGS. 5(*a*) to 5(*d*)
Figure 5:
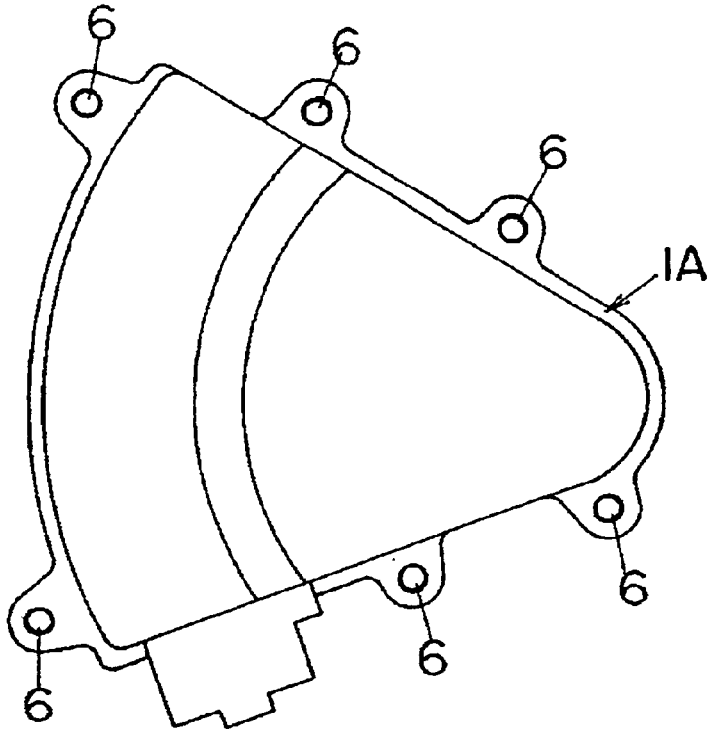
Figure 5:
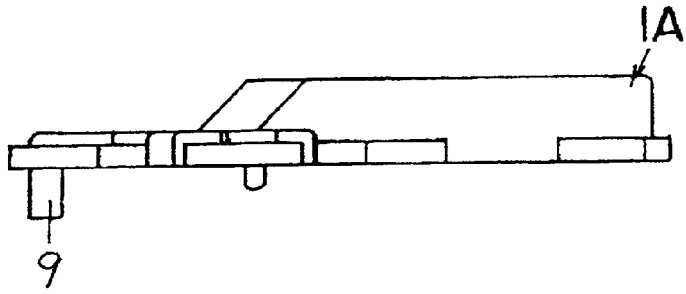
Figure 5:
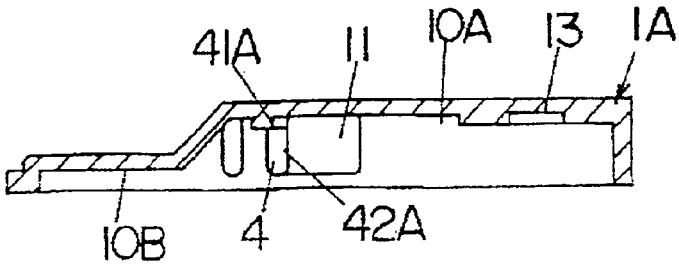
Figure 6A:
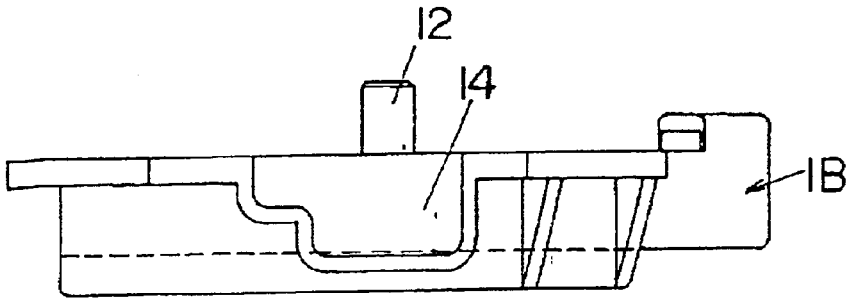
FIG. 6(*a*) is an upper surface view of a second base block used in the rotary switch according to the embodiment of the present invention.
Figure 6B:
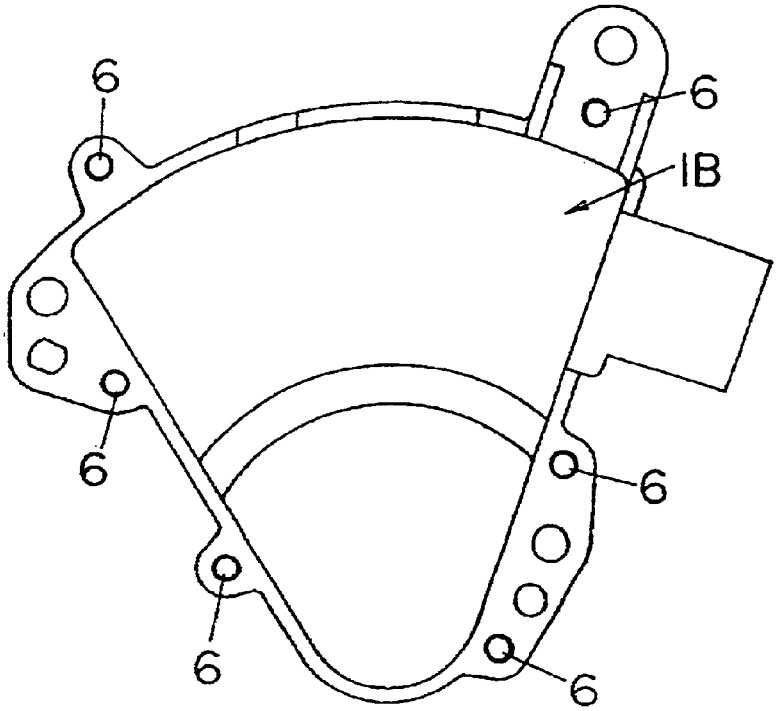
Figure 7A:
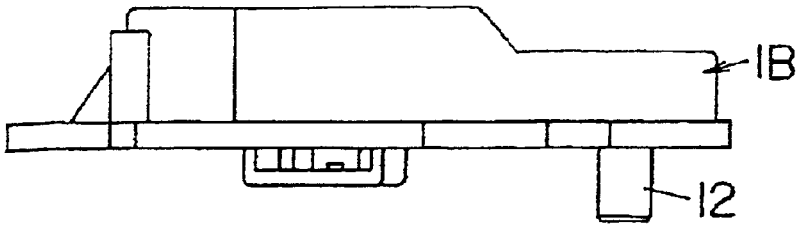
FIG. 7(*a*) is an upper surface view of the second base block used in the rotary switch according to the embodiment of the present invention, seen as the upper surface in FIGS. 7(*a*) to 7(*d*)
Figure 7B:
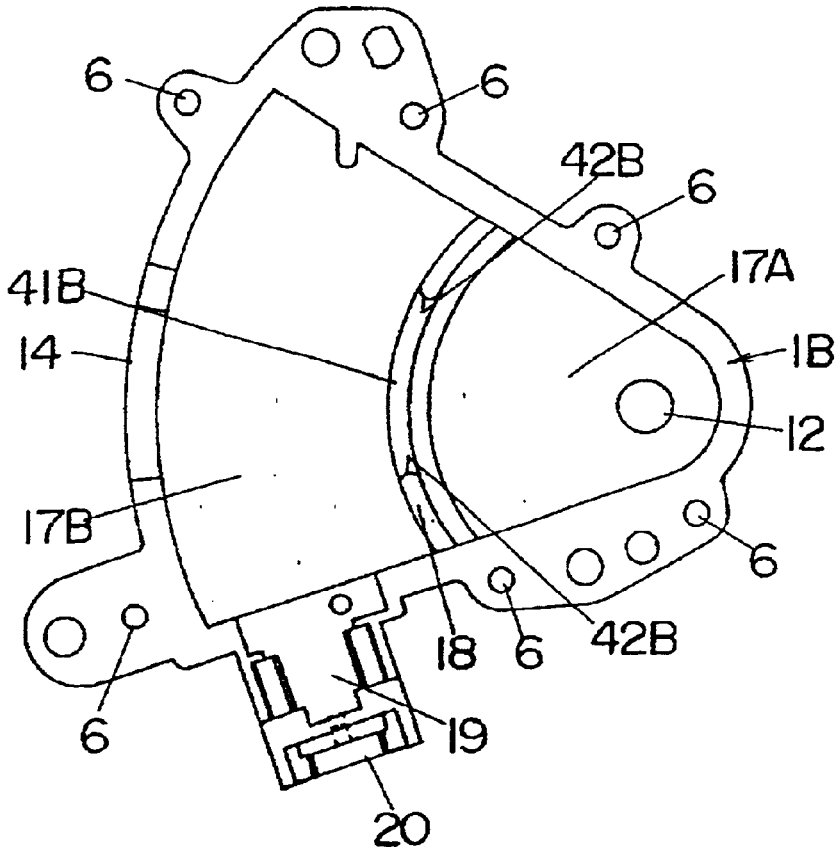
Figure 7C:
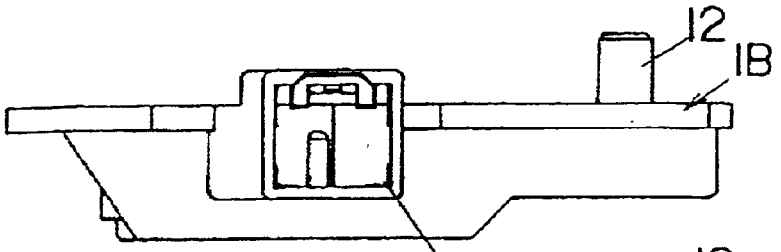
Figure 7D:
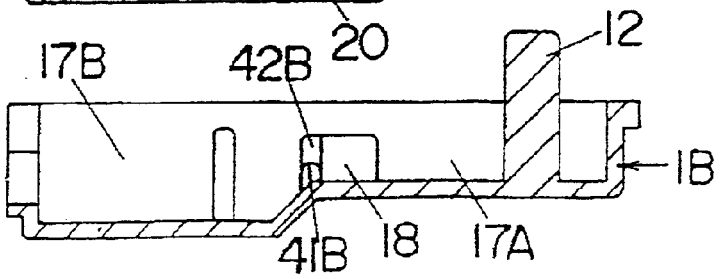
Figure 8A:
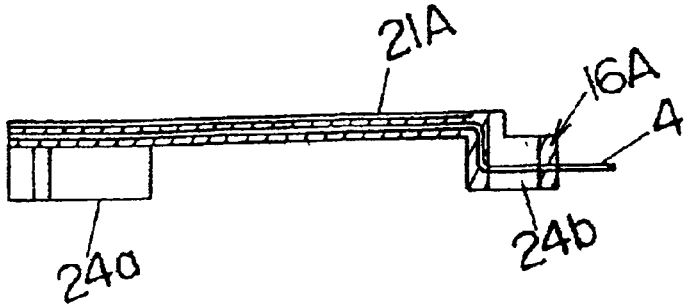
FIG. 8(*a*) is a horizontal sectional view of one of the stationary contact section used in the rotary switch according to the embodiment of the present invention.
Figure 8B:
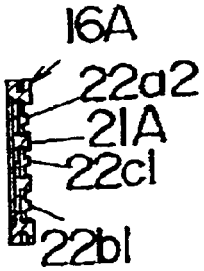
Figure 8D:
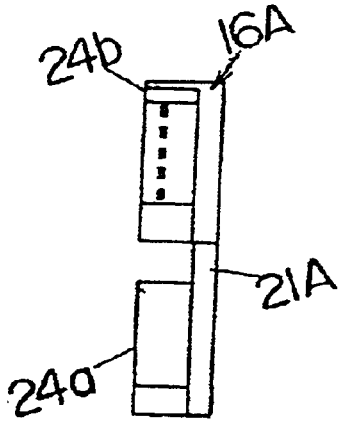
Figure 8C:
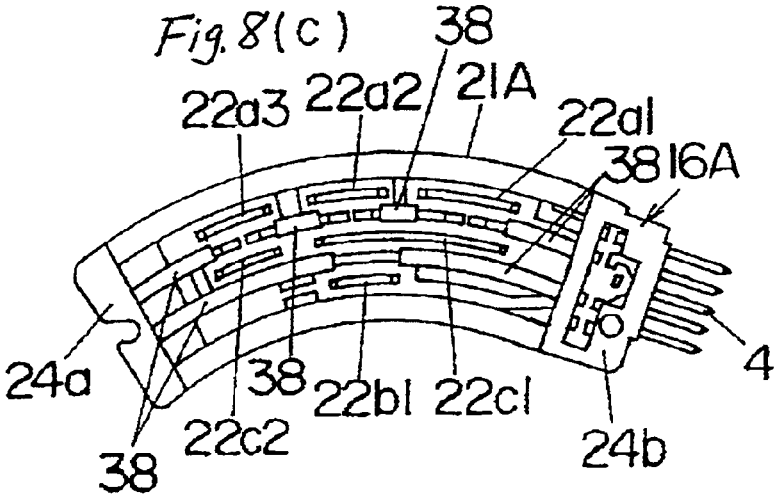
Figure 9A:
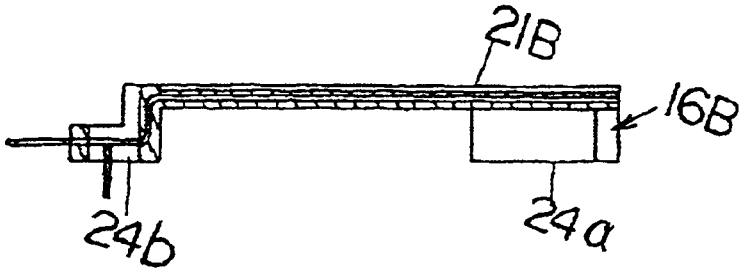
FIG. 9(*a*) is a horizontal sectional view of the other stationary contact section used in the rotary switch according to the embodiment of the present invention.
Figure 9B:
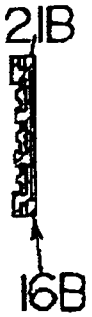
Figure 9D:
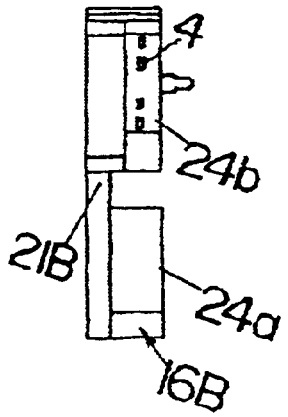
Figure 9C:
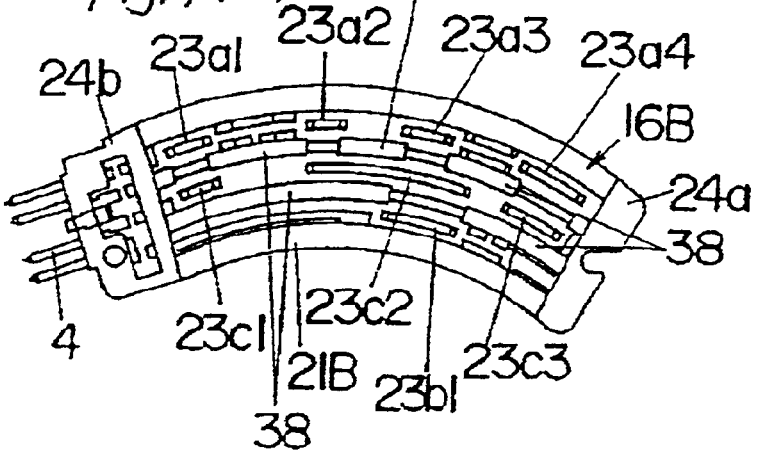
Figure 10A:
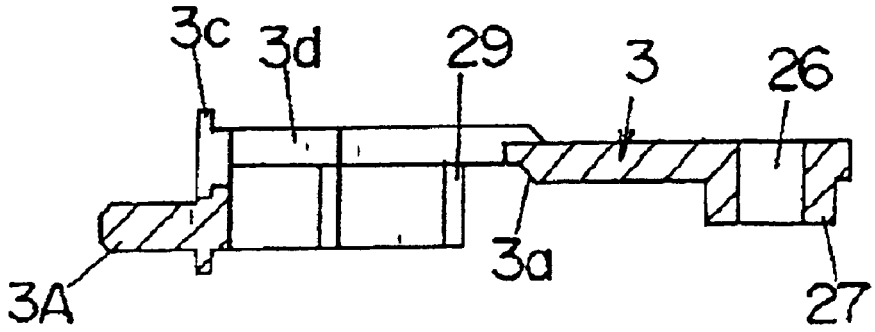
FIG. 10(*a*) is a horizontal sectional view of one of the operation handles used in the rotary switch according to the embodiment of the present invention.
Figure 10B:
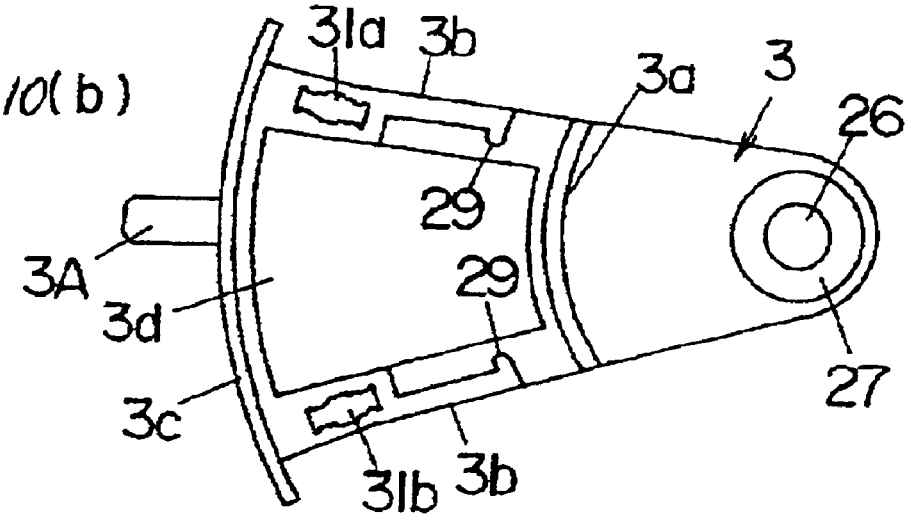
Figure 10C:
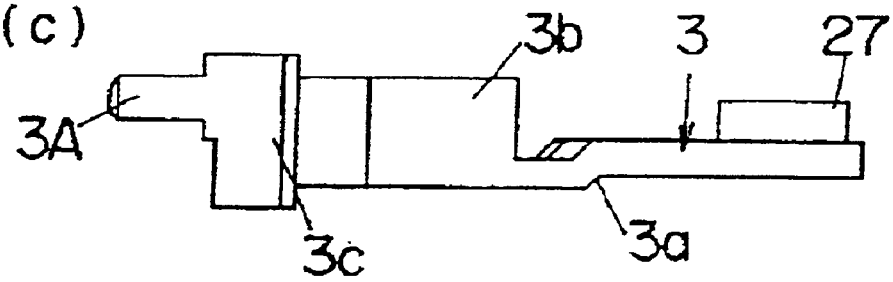
Figure 10D:
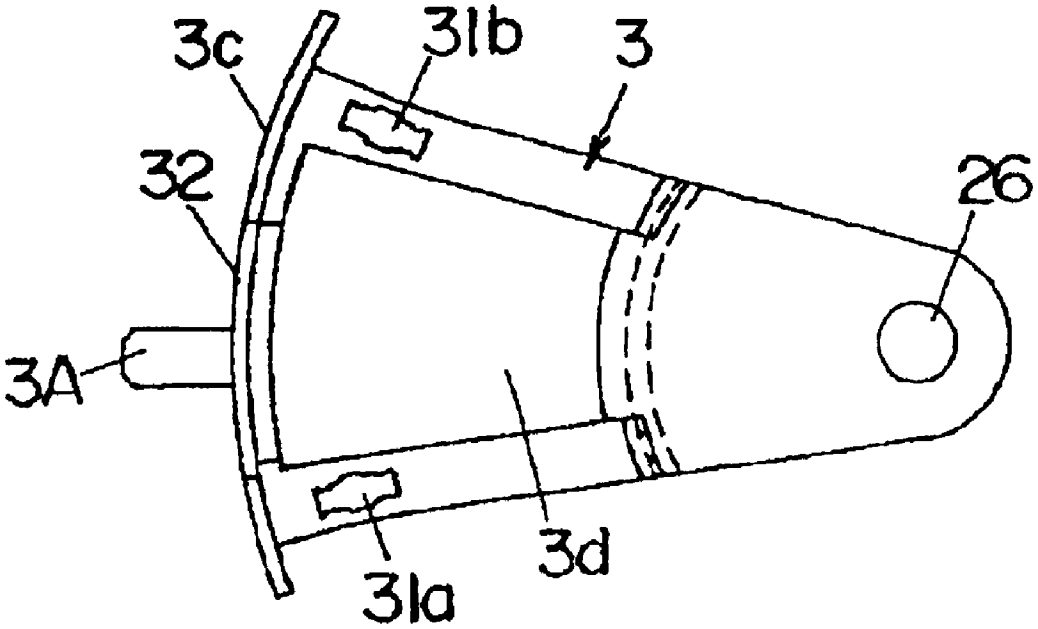
Figure 10E:
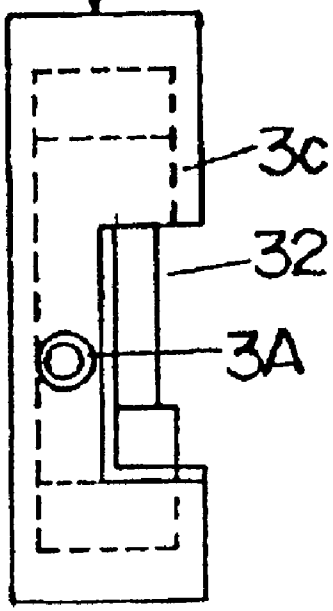

The instrument body 1 includes a first base block (1A) made of a molding of a synthetic resin (PBT) shown in FIGS. 4(*a*), 4(*b*) and FIGS. 5(*a*)–5(*d*), and a second base block (2A) made of a molding of a synthetic resin (PBT) shown in FIGS. 7(*a*)–7(*d*), FIGS. 6(*a*) and 6(*b*). The first base block (1A) is placed over the second base block (2A), and screw members 7 inserted into mounting holes 6 bored at respective outer peripheral portions of the base blocks (1A, 2A) are tightened by nuts 8 to connect the base blocks (1A, 2A), so that the instrument body 1 is formed.

The first base block (1A) is formed in a substantially fan-like shape as seen in a plan view. A slightly deep, depressed surface (10A) in a fan-like shape is formed from the main section toward a center portion on an inner side of the first base block (1A), and a slightly shallow, depressed surface (10B) is formed from the depressed surface (10A) toward a distal end direction seen from the main section on the inner side of the first base block (1A). Also, a substantially arc-shaped rib 11 is integrally formed at a boundary portion between the depressed surface (10A) and the depressed surface (10B).

A rotational shaft 12 (referred to FIGS. 7(*a*)–7(*d*)) is integrally formed with the second base block (1B), and a main portion of the depressed surface (10A) is depressed to have a bearing hole 13 for receiving the rotational shaft 12.

Figure 13B:
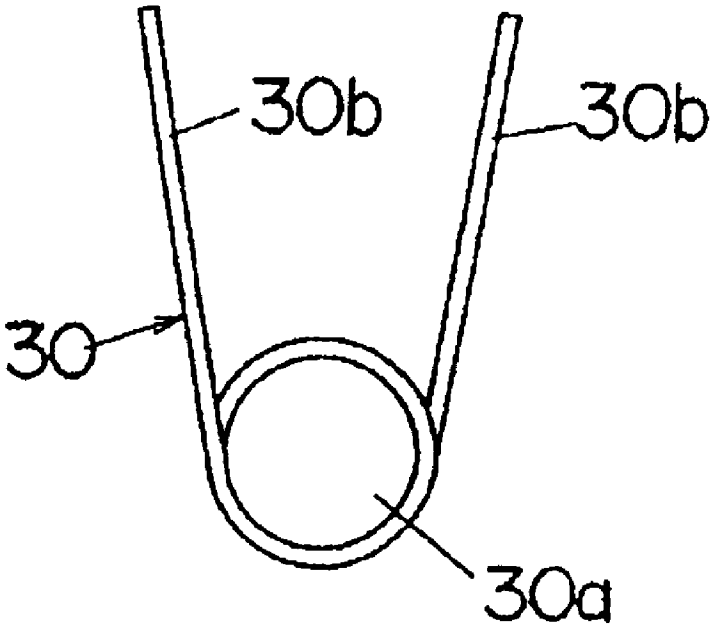
FIG. 13(*a*) is a side view of the other torsion spring used in the rotary switch according to the embodiment of the present invention.
Figure 13A:
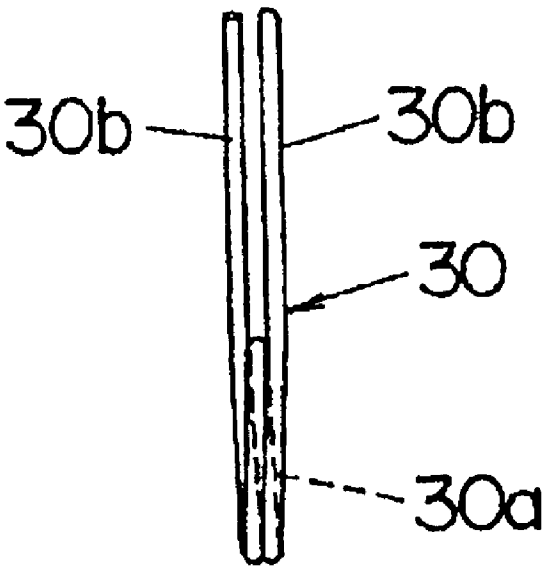

A central portion of the rib 11 is cut for a predetermined width to form a surface lower than a height of the rib 11, and this surface constitutes a guide portion (41A) for guiding a return torsion spring 30 (refer to FIGS. 13(*a*) and 13(*b*)), which is held by the operation handle 2. Also, standing wall surfaces located at both ends of the guide portion (41A) and extending along the rib 11 constitute stoppers (42A) which regulate a movement of the return torsion spring 30 to store the spring force for returning.

A projecting piece 9 integrally projects toward the inner side from a portion of the distal end portion of the base block (1A), which is located at a position slightly, comparatively closer to the center of the forward end portion of the base block (1A). The projecting piece 9 is fitted within a notch 14 formed on a surrounding wall of the distal end portion of the second base block (1B) as described later. Then, the depressed surface (10B) constitutes a portion where the stationary contact section (16A) shown in FIGS. 8(*a*) to 8(*d*) is placed.

Figure 11B:
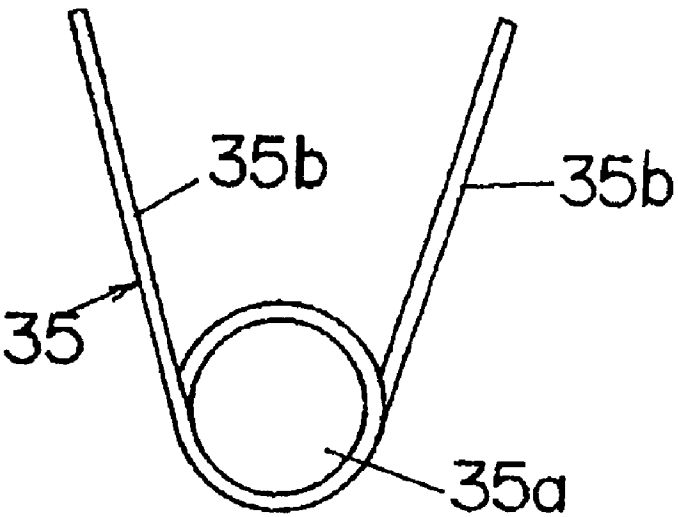
FIG. 11(*a*) is a side view of one of torsion springs used in the rotary switch according to the embodiment of the present invention.
Figure 11A:
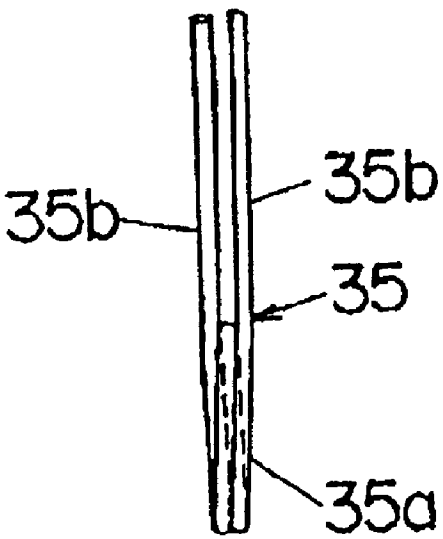
Figure 12A:
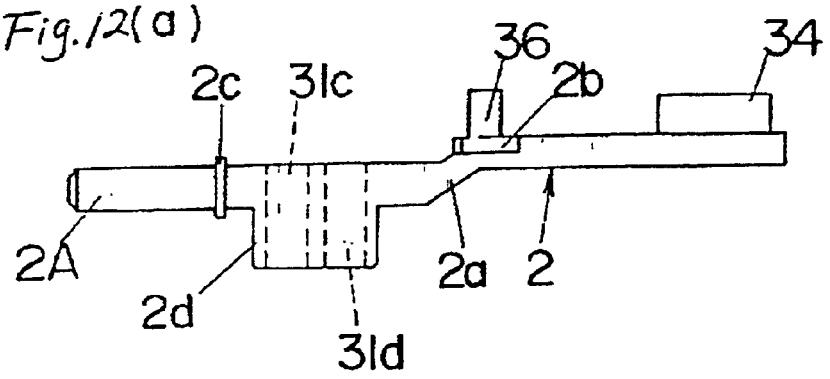
FIG. 12(*a*) is a side view of the other operation handle used in the rotary switch according to the embodiment of the present invention, as seen from one side.
Figure 12E:
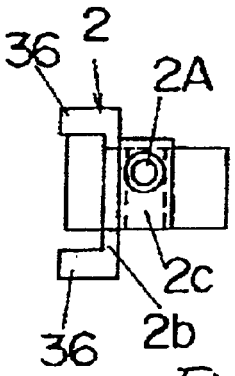
Figure 12B:
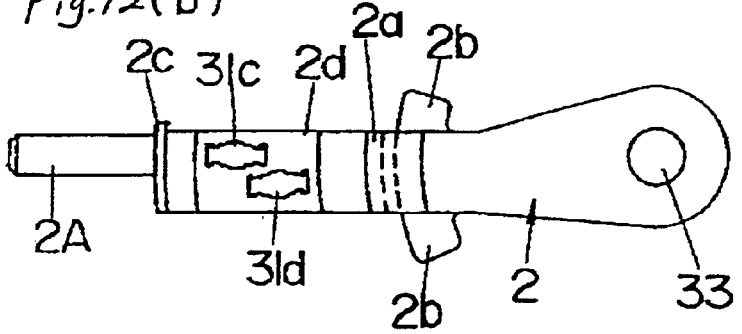
Figure 12C:
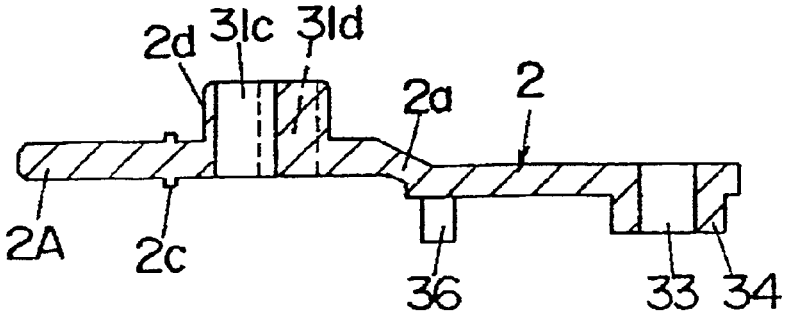
Figure 12D:
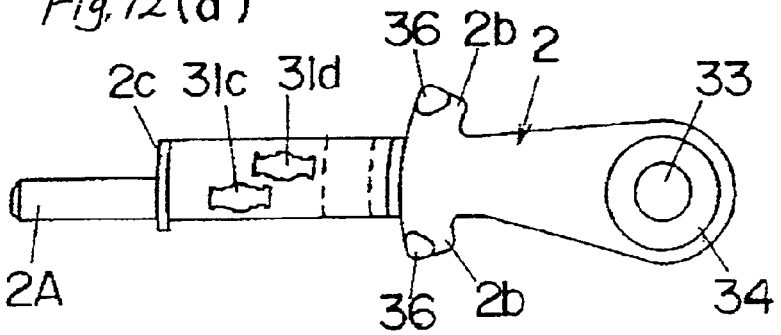

The other base plate (1B) placed over and connected to the base block (1A) is formed in a substantially fan-like shape as shown in FIGS. 6(*a*), 6(*b*) and FIGS. 7(*a*)–7(*d*). A substantially fan-like depressed surface (17A), which has a depth slightly deeper than that of the depressed surface (10A) is formed from the main section toward a center portion on an inner side of the second base block (1B), and a depressed surface (17B), which has a depth deeper than that of the depressed surface (17A) is formed from the depressed surface (17A) toward a distal end portion seen from the main section on the inner side of the second base block (1B). Also, a substantially arc-shaped rib 12 is integrally formed at a boundary portion between the depressed surface (17A) and the depressed surface (17B). A central portion of the rib 18 is cut for a predetermined width to form a surface lower than a height of the rib 18, and this surface constitutes a guide portion (41B) along which a return torsion spring 35 (refer to FIGS. 11(*a*) and 11(*b*)) held by the operation handle 3 slides. Also, standing wall surfaces located at both ends of the guide portion (41B) and extending along the rib 18 constitute stoppers (42B) which regulate a movement of the return torsion spring 35 to store the spring force for returning.

The rotational shaft 12 axially supports the operation handles 2, 3 such that the operation handles 2, 3 are freely rotatable, and the rotational shaft 12 is integrally projected at the main portion of the depressed surface (17A) in a fan-like shape.

Also, one side of the depressed surface (17B) includes a groove 19 where an output terminal group 4 forming a connector section 5 is disposed, and a plug insertion port 20 is opened in a side wall of the base block (1B) at a distal end of the groove 19. The base block (1A) covers an opening section of the groove 19 extending from the plug insertion port 20 to the depressed surface (17B), to thereby close the opening section of the groove 19.

Also, the depressed surface (17B) constitutes a portion where the stationary contact section (16B) shown in FIGS. 9(*a*) to 9(*d*) as described later is placed.

The notch 14 is formed at the central portion of the surrounding wall of the distal end portion of the base block (1B) along the depressed surface (17B). As shown in FIG. 6(*a*), the notch 14 has a wide opening width from the center thereof to a notch inlet, and a narrow opening width from the center thereof to the innermost or deepest bottom of the notch 14. By fitting the projecting piece 9 of the base block (1A) with the wide opening width side, the substantially Z-shaped opening window 15 is formed as shown in FIG. 2(*a*).

As shown in FIGS. 8(*a*) to 8(*d*), the stationary contact section (16A) provided at the depressed surface (10B) of the base block (1A) is formed of an arc-shaped resin molding base plate (21A), a stationary contact which is exposed on a base plate surface, and the output terminal group 4 projected from the end portion thereof. As shown in FIGS. 9(*a*) to 9(*d*), the stationary contact section (16B) provided at the depressed surface (17B) of the base block (1B) is formed of an arc-shaped resin molding base plate (21B), a stationary contact which is exposed on a base plate surface, and the output terminal group 4 projected from the end portion thereof. The stationary contact section (16A) and the stationary contact section (16B) are arranged such that the surfaces thereof opposed to each other at the time of connecting the base blocks (1A, 1B) constitute the surfaces where the stationary contacts are exposed. Protruding portions (24*a*, 24*b*) are integrally projected from both end portions of each of the respective resin molding base plates (21A, 21B) in a direction opposed to a projecting direction of the protruding portions of the other resin molding base plate. The protruding portions (24*a*, 24*b*) of the resin molding base plate (21A) face and contact with the protruding portions (24*a*, 24*b*) of the resin molding base plate (21B), so that a space where the operation handles 2, 3 can be moved is formed between the resin molding base plates (21A, 21B).

As shown in FIG. 8(*c*), the resin molding base plate (21A) includes three concentric circular arc lines arranged in parallel with equal intervals. Two substantially arc-shaped stationary contacts (22*c*1, 22*c*2) having respectively predetermined lengths and spaced with a predetermined interval therebetween are formed on a center concentric circular arc line among these concentric circular arc lines. These two stationary contacts (22*c* 1, 22*c*2) constitute a common contact and are formed of the same electric conductive plate. The stationary contacts (22*c*1, 22*c*2) are connected to an external circuit by the common output terminal extending from one end of the electric conductive plate. On the other hand, three substantially arc-shaped stationary contacts (22*a*1, 22*a*2, 22*a*3) having respective predetermined lengths and spaced with a predetermined interval therebetween are formed on the outer arc line. The stationary contacts (22*a*1, 22*a*2, 22*a*3) are respectively formed of different electric conductive plates, and are connected to the external circuit by output terminals extending from respective one ends of the electric conductive plates. A stationary contact (22*b*1) having a predetermined length is formed at an approximately center on the inner arc line, and connected to the external circuit by an output terminal extending from one end of an electric conductive plate forming the stationary contact (22*b*1).

As shown in FIG. 9(*c*), the other resin molding base plate (21B) includes three concentric circular arc lines arranged in parallel with equal intervals. Three substantially arc-shaped stationary contacts (23*c*1, 23*c*2, 23*c*3) having respectively predetermined lengths and spaced with predetermined intervals therebetween are formed on a center concentric circular arc line among these concentric circular arc lines. These three stationary contacts (23*c*1, 23*c*2, 23*c*3) constitute a common contact and are formed of the same electric conductive plate. The three stationary contacts (23*c*1, 23*c*2, 23*c*3) are connected to an external circuit by the common output terminal extending from one end of the electric conductive plate. On the other hand, four substantially arc-shaped stationary contacts (23$a$1, 23$a$2, 23$a$3, 23$a$4) having respective predetermined lengths and spaced with predetermined intervals therebetween are formed on the outer arc line. The stationary contacts (23$a$2, 23$a$3) at the center portion of the outer arc line are formed of the same electric conductive plate, and the stationary contacts (23$a$1, 23$a$4) at both end portions of the outer arc line are respectively formed of different electric conductive plates. The stationary contacts (23$a$1, 23$a$2, 23$a$3, 23$a$4) are connected to the external circuit by output terminals extending from respective one ends of the electric conductive plates. A stationary contact (23$b$1) having a predetermined length is formed at a position slightly deviated to the other end side from the center of on the inner arc line, and connected to the external circuit by the output terminal extending from one end of an electric conductive plate forming the stationary contact (23$b$1).

In the state that the resin molding base plates (21A, 21B) are respectively disposed at the depressed surfaces (10B, 17B) of the base blocks (1A, 1B), the center of the three parallel arc lines described above constitutes a center of the rotational shaft 12, in other words, a rotational center of the operation handles 2, 3.

Now, the operation handles 2, 3 used in the embodiment are explained.

Firstly, as shown in FIGS. 10($a$) to 10($d$), the operation handle 3 is formed of a resin molding having a substantially fan-shaped outline. One end side (main portion of the fan shape) of one surface side of the operation handle 3 integrally includes a cylindrical section 27. An axial hole 26 is bored through the cylindrical section 27, and the rotational shaft 12 of the base block (1A) passes through the axial hole 26. Also, a step portion (3$a$) reaching both sides is formed at a substantially central position of the operation handle 3, such that a portion extending from the one end side of the operation handle 3 to the substantial central portion is higher in the projecting direction of the cylindrical section 27 than the portion extending from the substantial central portion of the other end side. The cylindrical section 27 constitutes a spring seat which is fitted with a twisted portion (35$a$) of the torsion spring 35 shown in FIGS. 11($a$) and 11($b$) as a spring for returning the operation handle 3.

In one surface side of the operation handle 3, a standing wall (3$b$) is integrally projected between both sides of the other end of the operation handle 3 and at both sides extending from both the sides of the other end to a positions near the step portion (3$a$). Stoppers 29 opposed to each other are respectively projected at opposing surfaces of both distal ends of the substantially C-shaped standing wall (3$b$). Both side legs (35$b$) of the torsion spring 35 are elastically in contact with the stoppers 29, so that the stoppers 29 regulate the expanding angle between the legs (35$b$) at a constant angle. Further, an opening window (3$d$) is formed at a portion surrounded by the substantially C-shaped standing wall (3$b$).

Holes (31$a$, 31$b$) for attaching the movable contact members are respectively bored through both side portions of the standing wall (3$b$) at positions comparatively closer to the distal end portion of the operation handle 3. The holes (31$a$, 31$b$) are longitudinal in the longitudinal direction of the operation handle 3, and include centers expanded sideways. Positions of both end portions of the holes (31$a$, 31$b$) are located at positions extending between each of the outer arc lines, on which the stationary contacts (22$a$1, 22$a$2, 22$a$3) formed on the stationary contact section (16A) and the stationary contacts (23$a$1, 23$a$2, 23$a$3, 23$a$4) on the stationary contact section (16B) are respectively disposed, to each of the center arc lines, where the stationary contacts (22$c$1, 22$c$2, 23$c$1, 23$c$2, 23$c$3) are respectively disposed, when the operation handle 3 is axially supported by the rotational shaft 12 of the base block (1B) to be freely movable and the stationary contact sections (16A, 16B) are respectively disposed at the depressed surfaces (10B, 17B) of the base blocks (1A, 1B). Also, the center lines of the holes (31$a$, 31$b$) in the width direction are positioned on lines passing through the rotational center of the operation handle 3.

A collar portion (3$c$) is integrally projected at the peripheral portion of the standing wall (3$b$) at the distal end side, an opening 32 is notched in the other surface side of the operation handle 3 to extend from a substantially central portion toward one side of both side direction of the collar portion (3$c$). Also, the operating section (3A) is integrally projected on an outer surface of the collar portion (3$c$) corresponding to the central position of both side direction of the opening 32.

As shown in FIGS. 12($a$) to 12($e$), the operation handle 2 is formed of a resin molding in a substantially rod shape with a narrow width, and one end portion of one surface side of the operation handle 2 integrally includes a cylindrical section 34. An axial hole 33 is bored through the cylindrical section 34, and the rotational shaft 12 of the base block (1A) passes through the axial hole 33. Also, a step portion (2$a$) reaching both sides is formed at a substantially central position of the operation handle 2, such that a portion extending from the one end side of the operation handle 2 to the substantial central portion is higher in the projecting direction of the cylindrical section 34 than the portion extending from the substantial central portion of the other end side. The cylindrical section 34 constitutes a spring seat which is fitted with a twisted portion (30$a$) of the torsion spring 30 shown in FIGS. 13($a$) and 13($b$) as a spring for returning the operation handle 2. Projecting portions (2$b$) are integrally formed at both sides of one surface side of the operation handle 2 near the step portion (2$a$). Stoppers 36 are integrally projected from the projecting portions (2$b$), and both side legs (30$b$) are elastically in contact with the stoppers 36, to thereby regulate the expanding angle between both legs (30$b$) of the torsion spring 30.

A thick portion (2$d$) is formed at a substantial central portion of the other surface side between the step portion (2$a$) and the distal end portion of the operation handle 2. Holes (31$c$, 31$d$) for attaching movable contact members are bored through the thick portion (2$d$) and arranged in parallel such that one end position of one hole (31$c$) is located at the other end position of the other hole (31$d$). Positions of both end portions of the hole (31$c$) are located at positions extending from each of the outer arc lines, on which the stationary contacts (22$a$1, 22$a$2, 22$a$3) formed on the stationary contact section (16A) and the stationary contacts (23$a$1, 23$a$2, 23$a$3, 23$a$4) on the stationary contact section (16B) are respectively disposed, to each of the center arc lines, where the stationary contacts (22$c$1, 22$c$2, 23$c$1, 23$c$2, 23$c$3) are respectively disposed, when the operation handle 2 is axially supported by the rotational shaft 12 of the base block (1B) to be freely movable and the stationary contact sections (16A, 16B) are respectively disposed at the depressed surfaces (10B, 17B) of the base blocks (1A, 1B). Also, the center line of the hole (31$c$) in the width direction is positioned on the line passing through the rotational center of the operation handle 2.

Positions of both end portions of the other hole (31$d$) are located at positions extending from each of the center arc lines, where the stationary contacts (22$c$1, 22$c$2, 23$c$1, 23$c$2, 23*c*3) of the stationary contact sections (16A, 16B) are respectively disposed, to each of the inner arc lines, where the stationary contacts (22*b*1, 23*b*1) are respectively disposed. Also, the center line of the hole (31*d*) in the width direction is positioned on the line passing through the rotational center of the operation handle 2.

A collar portion (2*c*) is integrally formed at the distal end portion of the operation handle 2, and the operating section (2A) is integrally projected from a front surface of the collar portion (2*c*).

Figures 14A, 14B:
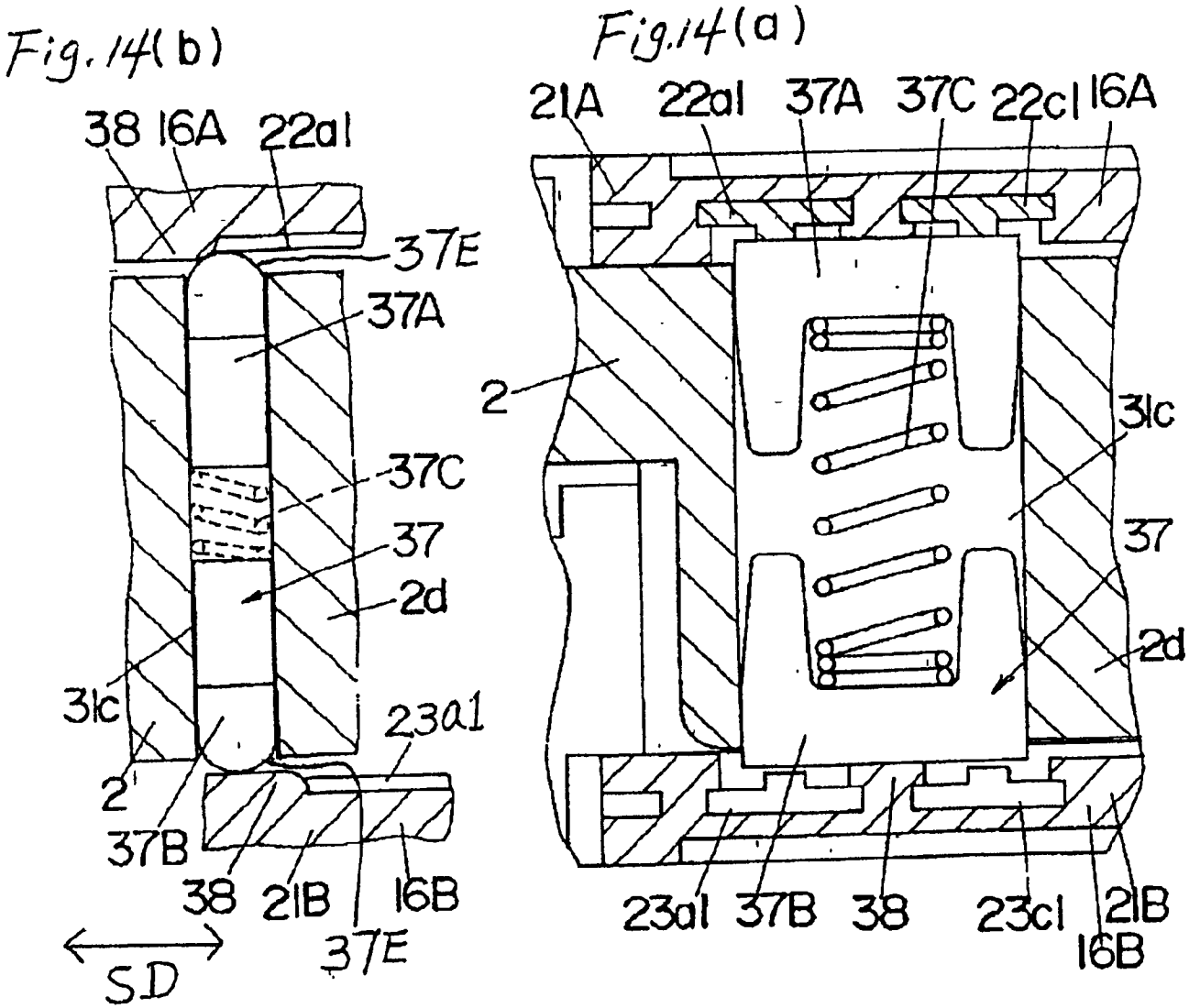
FIGS. 14(*a*) and 14(*b*) are explanatory views showing arrangement of a movable contact member used in the rotary switch according to the embodiment of the present invention.

Now, movable contact members 37 fitted in the holes (31*a*, 31*b*, 31*c*, 31*d*) of the operation handles 2, 3 are explained with reference to FIGS. 14(*a*) and 14(*b*). Here, for the purpose of simplifying the explanation, there will be explained a case that the movable contact member 37 is fitted in the hole (31*c*) bored through the thick portion (2*d*) of the operation handle 2.

A movable contact member 37 includes two U-shaped movable contacts (37A, 37B), and a coil spring (37C) formed of an electric conductive member, which is interposed between the movable contacts (37A, 37B) to urge the movable contacts (37A, 37B). The movable contact member 37 is fitted inside the hole (31*c*) such that central pieces of the movable contacts (37A, 37B) constituting contact surfaces are exposed from openings at both ends of the hole (31*c*). Then, at a certain rotated position of the operation handle 2, the coil spring (37C) urges an outer surface of the central piece of the movable contact (37A) to be elastically in contact with the stationary contacts (22*a*1, 22*c*1) of the stationary contact section (16A), resulting in shorting between the stationary contacts (22*a*1, 22*c*1), for example. At this time, in the stationary contact section (16B) at the opposite side, arc-shaped ribs 38 are integrally formed on the resin molding base plate (21B) in a space between the positions where the stationary contacts (23*a*1, 23*a*2, 23*a*3, 23*a*4) are provided and the positions where the stationary contacts (23*c*1, 23*c*2, 23*c*3) are provided, and the movable contact (37B) runs into the rib 38, so that the stationary contacts are parted. The movable contact 37 has a tip ends (37E) which are configured to slide on the stationary contact 22. The tip end (37E) has a rounded cross-section taken along a sliding direction (SD) of the movable contact 37.

In other words, in the stationary contacts of the stationary contact sections (16A, 16B) disposed on two adjacent arc lines, across which the movable contact (37A) or movable contact (37B) extends, it is determined whether the stationary contacts are shorted or parted depending on whether the rib 38 higher than the contact surfaces of the stationary contacts is interposed between the two adjacent arc lines. As shown in FIGS. 8(*a*)–8(*d*) and FIGS. 9(*a*)–9(*d*), predetermined arc-shaped ribs 38 are formed on the resin molding base plate (21A, 21B), so that various rotated positions of the operation handles 2, 3 can be detected by combinations of the presence and absence of short outputs between the stationary contacts by the movable contacts (37A, 37B) of the movable contact members 37 fitted in the respective holes (31*a*, 31*b*, 31*c*, 31*d*) of the operation handles 2, 3

Figure 15B:
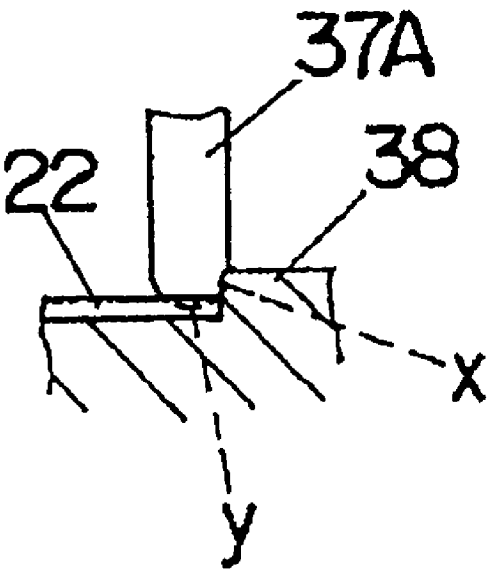
FIGS. 15(*a*) and 15(*b*) are explanatory views for explaining the movable contact and the stationary contact used in the rotary switch according to the embodiment of the present invention.
Figure 15A:
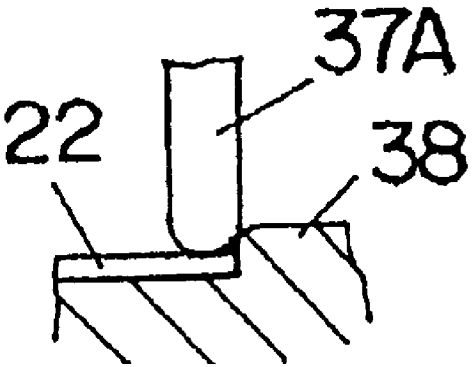

Also, as shown in FIG. 15(*a*), the contact surface of the movable contact (37A or 37B) is formed as a rounded surface, and an end surface of the rib 38, onto which the movable contact (37A or 37B) strikes to separate the contacts, is formed in the R surface, so that the movable contact (37A or 37B) can easily slide onto the rib 38. The contact surface of the movable contact has a smooth surface, but not a rough surface. When the movable contacts (37A, 37B) repeatedly slide onto the ribs 38, the end surface of each rib 38 is worn out at a point (x) as shown in FIG. 15(*b*). However, the contact surface of the stationary contact (designated by the numeral reference 22 in the figure) is similarly worn out at a point (y), so that the abrasions are balanced, resulting in that the deviation between the strike point and the contact position is small.

Figure 16:
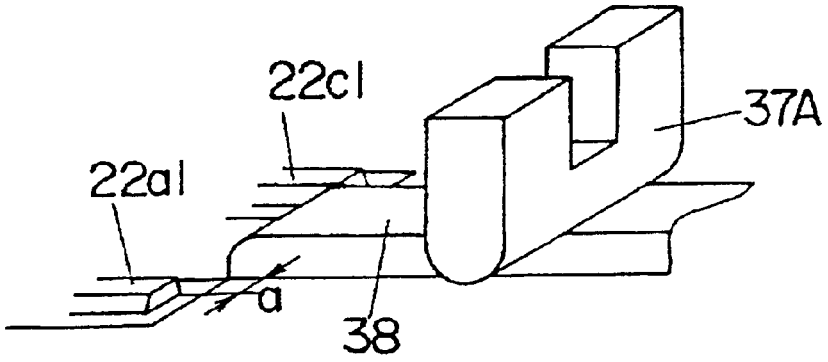
FIG. 16 is an explanatory view for explaining a relationship between the movable contact, the stationary contact, and a rib used in the rotary switch according to the embodiment of the present invention.

Further, as shown in FIG. 16, the rib 38 is formed between the stationary contacts (for example, 22*a*1, 22*c*1) at both sides. Accordingly, when the movable contact (37A) runs upon the rib 38, the connection between the stationary contacts (22*a*1, 22*c*1) is cut at both sides, to thereby effectively cut off the arc.

Also, the stationary contacts (22*a*1, 22*c*1 in FIG. 16) at both sides include contact surfaces facing the end surface side of the rib 38, and a space (a) is formed between a side rim of each of the contact surfaces of the stationary contacts (22*a*1, 22*c*1) and adjacent side rim of the rib 38 as shown in FIG. 16.

As shown in FIG. 1, in the embodiment of the invention, in order to prevent the trouble due to the abrasion powder as in the conventional rotary switch, a contact surface (A) of the stationary contact (designated by numeral reference 22 in FIG. 1) is finished to be a rough surface which has zigzagged ridges. Maximum height of the zigzagged ridges are at least approximately 2 $\mu$m and at most approximately 8 $\mu$m. A lubricant, for example, a grease 50 is applied to the contact surface (A). As a surface roughening method, a blast treatment in which particles such as alumina are sprayed, or a surface grinding method by using particles of silicon may be used.

If zigzagged ridges are formed on the sliding surface of the stationary contact by forming grooves using a cutting method, lubricant is not uniformly supplied because grease may be supplied only in the vicinity of the grooves. Further, secure contact between the stationary contact and the movable contact is obtained only in the vicinity of the grooves, because oil film formed on the stationary contact may be broken by flowing the oil into the groove. On the other hand, if a surface roughening method such as the blast treatment is used, zigzagged ridges are closely, randomly and uniformly formed on the sliding surface of the stationary contact 22. Accordingly, the sliding surface of the stationary contact uniformly retains the grease 50 thereon. Further, secure contact between the stationary contact and the movable contact may be obtained over the sliding surface of the stationary contact 22, because oil film formed on the stationary contact may be easily broken since the oil easily flows all over the sliding surface of the stationary contact 22. Furthermore, high contact pressure may be obtained because a plurality of small tip ends of the stationary contact 22 contacts the movable contact 37. Accordingly, in the present embodiment, high contact pressure may be maintained over the stationary contact 22. Therefore, high contact reliance may be obtained.

Since the rough contact surface (A) can uniformly hold the grease 50, the grease 50 is supplied to the movable contact 37 from the rough contact surface (A) and flows from the surface of the movable contact 37 to the rib 38 even if the movable contact 37 slides upon the rib 38. Accordingly, in case the movable contact 37 slides on the contact surface, or in case the movable contact 37 slides on the rib 38, the contact surface and the rib are prevented from being worn out and the generation of the metal powder and the resin powder reduce because of the grease 50. Moreover, in case the movable contact (designated by the numeral reference 37 in FIG. 1) slides along and makes contact with the contact surface, the oil film can be easily broken due to the rough contact surface when the movable contact 37 is in contact with the contact surface (A) of the stationary contact 22, resulting in achieving the stable contact. In the present embodiment, the rough contact surface (A) is provided on the stationary contact 22. Accordingly, stable contact and improved slidability may be obtained. The rough contact surface (A) is provided on the stationary contact 22 in the present embodiment. Instead, the rough contact surface (A) may be provided on the movable contact 37.

In order to assemble the rotary switch according to the embodiment of the invention, in a state that the respective constituent members of the movable contacts 37 are fitted in the holes (31*a*, 31*b*, 31*c*, 31*d*) of the operation handles 2, 3, the cylindrical sections 27, 34 are positioned to face away from each other such that the axial holes 26, 33 communicate with each other, to thereby place the other surface sides of the operation handles 2, 3 one over the other. In this case, a washer (not shown) is interposed between the opening portions of the axial holes 26, 33. Then, the collar portion (2*c*) of the operation handle 2 is fitted into the opening 32 of the collar portion (3*c*) of the operation handle 3 such that the collar portion (2*c*) is freely movable in the sideway direction, to thereby project the operating section (2A) to the outside. At the same time, the thick portion (2*d*) of the operation handle 2 is accommodated in the opening window (3*d*), so that the end surface of the thick portion (2*d*) is exposed to the opposite side surface of the operation handle 3.

At this time, the other surface sides of the projecting portions (2*b*) of the operation handle 2 are placed over the other surface sides at both sides of the opening window (3*d*) of the operation handle 3. Also, one surface of the portion of the operation handle 2, which extends from the position of the step portion (2*a*) to the collar portion (2*c*) is at the height slightly lower than the other surface of the operation handle 3 at both sides of the opening window (3*d*).

From both surface sides of the blocks assembled by placing the two operation handles 2, 3 one over the other, the resin molding base plates (21A, 21B) of the stationary contact sections (16A, 16B) are disposed to face against each other. Then, surfaces of the protruding portions (24*a*) of both resin molding base plates (21A, 21B) are in contact with each other, and surfaces of the protruding portions (24*b*) of both resin molding base plates (21A, 21B) are in contact with each other. Then, the resin molding base plates (21A, 21B) are connected with each other in a state that the operation handles 2, 3 are interposed between the resin molding base plates (21A, 21B). At this time, in a state that the collar portion (2*c*) of the operation handle 2 faces in the opening 32, the collar portion (3*c*) of the operation handle 3 covers the peripheral rim of the outside opening of a space formed by the resin molding base plates (21A, 21B) such that the collar portion (3*c*) of the operation handle 3 is freely movable along the distal end surfaces of the resin molding base plates (21A, 21B). Accordingly, the operating sections (2A, 3B) of the operation handles 2, 3 are projected outside.

After the stationary contact sections (16A, 16B) are assembled, the twisted portion (35*a*) of the torsion spring 35 is fitted into the cylindrical section 27 of the operation handle 3. Then, while both legs (35*b*) opened in a V shape of the torsion spring 35 are bent in the opposing directions, the legs (35*b*) are fitted between the stoppers 29 to elastically make contact with the stoppers 29. Similarly, the twisted portion (30*a*) of the torsion spring 30 is fitted into the cylindrical section 34 of the operation handle 2. While both legs (30*b*) opened in a V shape of the torsion spring 30 are bent in the opposing directions, the legs (30*b*) are fitted between the stoppers 36 to elastically make contact with the stoppers 36.

After the torsion springs 30, 35 are attached, the cylindrical section 27 side of the operation handle 3 is faced against the base block (1B), and the rotational shaft 12 of the base block (1B) is inserted into the axial hole 26 of the cylindrical section 27, a hole of the interposed washer, the axial hole 33 of the cylindrical section 34 of the operation handle 2. Then, the stationary contact section (16B) is disposed at the depressed surface (17B) of the base block (1B), and output terminal groups 4 respectively projecting one end portions of the stationary contact sections (16A, 16B) are stored in the groove 19. At this time, portions of the legs (35*b*), which are located at more forward positions than the positions making contact with the stoppers 29, make contact with the stoppers (42B) provided at both ends of the guide portion (41B) of the rib 18 formed at the central portion of the base block (1B), and are disposed to be freely movable with respect to the guide portion (41B).

The collar portion (3*c*) of the operation handle 3 disposed along the outside opening rim of the space formed by the resin molding base plates (21A, 21B) is movably stored in a space formed between the rear surface of the distal end side surrounding wall of the base block (1B) and the outside opening rim of the space formed by the resin molding base plates (21A, 21B). Here, the width of the collar portion (3*c*) in the longitudinal direction is formed to be longer than the width in the corresponding direction of the notch 14 formed on the distal end side surrounding wall of the base block (1B).

Then, the operating section (3A) of the operation handle 3 passes through the notch 14 from the side where the operation section (3A) is located at the bottom side of the depressed surface (17B) of the base block (1B), and is projected outside from the base block (1B).

After attaching the constituent members to the base block (1B), the base block (1B) is attached to cover the base block (1A) from the one surface side of the operation handle 2. At this moment, the distal end of the rotational shaft 12 projected from the axial hole 33 of the cylindrical section 34 of the operation handle 2 is freely rotatably fitted to the bearing hole 13 formed at one end portion of the depressed surface (10A) of the base block (1A), and the resin molding base plate (21A) is disposed in the depressed surface (10*b*) of the base block (1A). At this time, portions of the legs (30*b*), which are located closer to the twisted portion (30*a*) than the positions making contact with the stoppers 36, make contact with the stoppers (42A) provided at both ends of the guide portion (41A) of the rib 11 formed at the central portion of the base block (1A), and are disposed to be freely movable with respect to the guide portion (41A).

Figure 17:
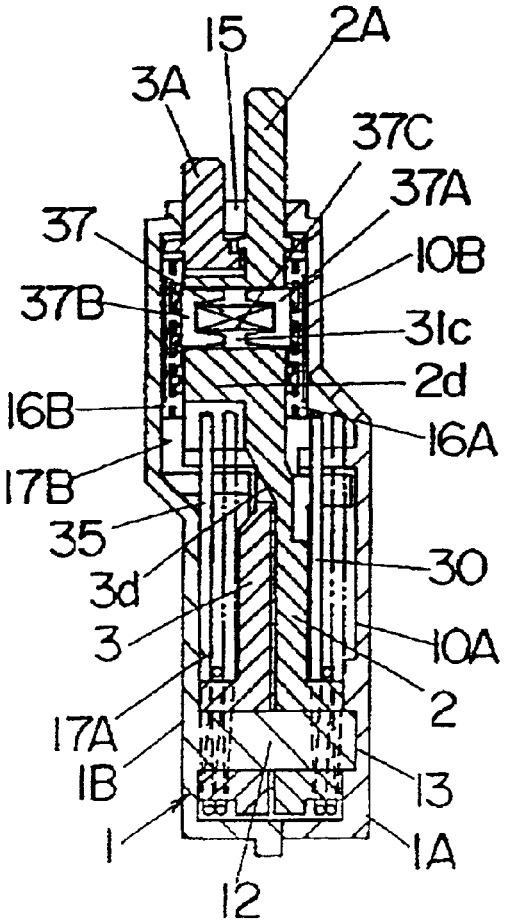
FIG. 17 is a side sectional view of the rotary switch according to the embodiment of the present invention.

After the base block (1B) is attached to cover the base block (1A) as described above, the base blocks (1A, 1B) are fixed by screws, to thereby complete the rotary switch, in which the operation handles 2, 3, and the stationary contact sections (16A, 16B) are stored in the instrument body 1 as shown in FIG. 17.

Figure 18:
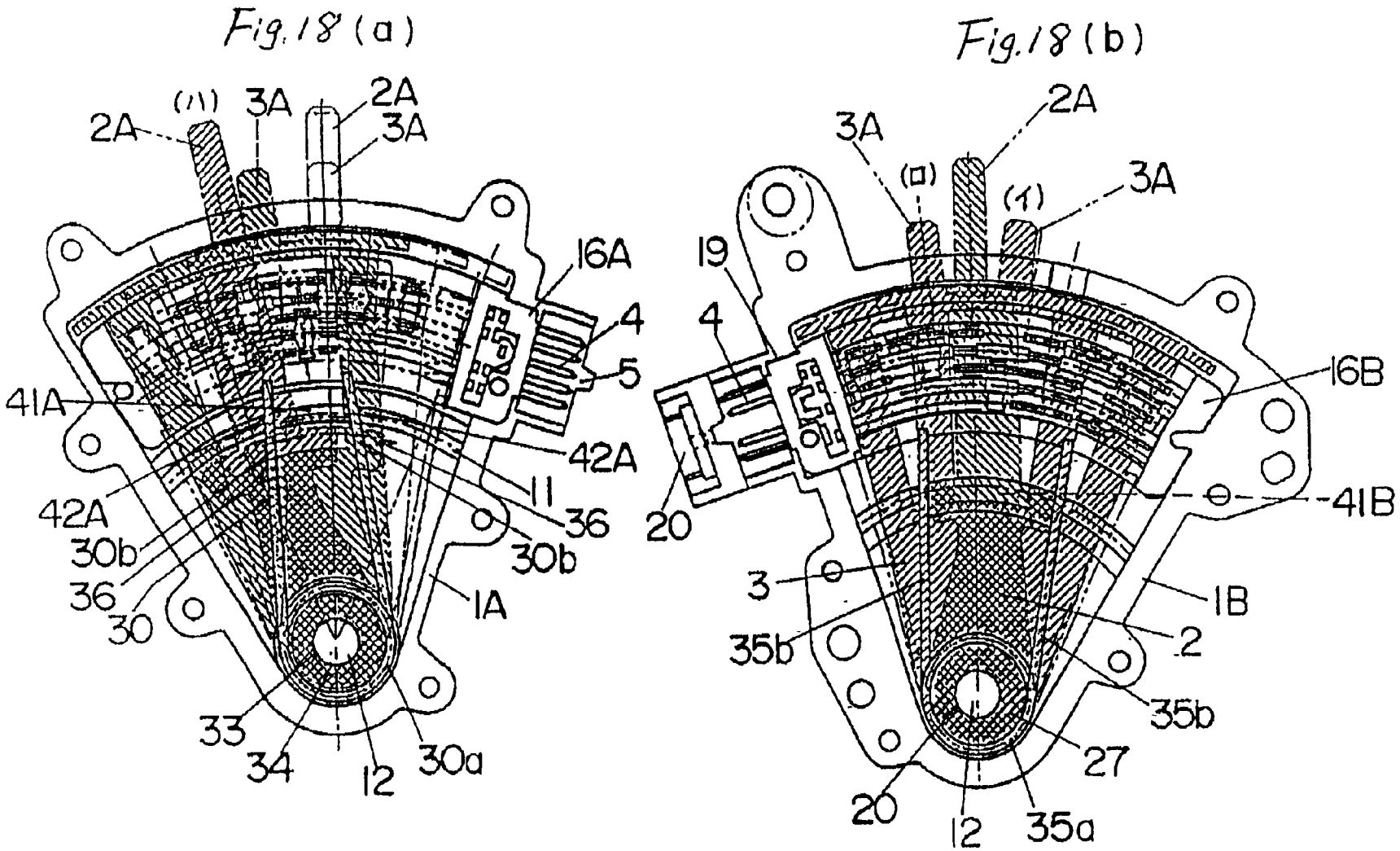
FIGS. 18(*a*) and 18(*b*) are explanatory views for explaining operations of the rotary switch according to the embodiment of the present invention.

Now, operations of the rotary switch are explained briefly with reference to FIGS. 18(*a*) and 18(*b*). Firstly, rotations of the operation handles 2, 3 are operated by the interlocking mechanism connected to the shift lever of the automobile, for example. In case the shift lever is at the normal position, in the operation handles 2, 3, movements of the torsion springs 30, 35 respectively attached to the operation handles 2, 3 are regulated in the state shown in FIGS. 18(*a*) and 18(*b*)

by the stoppers (42A, 42B) of the base blocks (1A, 1B). The collar portion (2*c*) of the operation handle 2 is located at the center of the opening 32 of the operation handle 3, and the operating section (2A) of the operation handle 2 is located at the position where the operating section (2A) is substantially overlapped with the operating section (3A) of the operation handle 3.

In this state, the operation handle 3 can be rotated in a right or left direction to be at a position, that is, a position (b) or (c) in FIG. 18(*b*), where a right or left end surface of the collar portion (2*c*) of the operation handle 2 abuts against a left or right inner end surface of the opening 32 of the operation handle 3.

At this time, between the right and left legs (35*b*) of the torsion spring 35 attached to the operation handle 3, the leg (35*b*) in the rotational direction side is regulated by the corresponding stopper (42B) formed in the base block (1B). While the other leg (35*b*) is bent by receiving the pressing force by the corresponding stopper 29 of the operation handle 3, the other leg (35*b*) moves on the guide portion (41B). Therefore, when the operating force by the operation handle 3 is released, the operation handle 3 returns to the normal position by receiving the returning force of the leg (35*b*) in the side where the torsion spring 35 is bent.

On the other hand, when the operating section (2A) of the operation handle 2 is rotated in the left direction, in other words, when the operating section (2A) is rotated in the direction opposite to the projecting piece 9 entering in the notch 14, the collar portion (2*c*) collides with the inner side surface of the opening 32 in the rotational direction, to rotate the operation handle 3 together in the same direction. At this time, in the torsion spring 30 attached to the operation handle 2, the movement of the leg (30*b*) in the rotational direction is regulated by the corresponding stopper (42A) formed in the base block (1A), and while the other leg (30*b*) is bent by receiving the pressing force by the corresponding stopper (36) of the operation handle 2, the other leg (30*b*) moves on the guide portion (41A). At the same time, in the torsion spring 35 attached to the operation handle 3, the movement of the leg (35*b*) in the rotational direction side is regulated by the corresponding stopper (42B) formed in the base block (1B), and while the other leg (35*b*) is bent by receiving the pressing force by the corresponding stopper 29 of the operation handle 3, the other leg (35*b*) moves on the guide portion (41B).

When the operating force of the operation handle 2 is released at a position (d) in FIG. 18(*a*), the operation handle 2 returns to the normal position by receiving the returning force by the leg (30*b*) in the side where the torsion spring 30 is bent. At the same time, the operation handle 3 returns to the normal position by receiving the returning force by the leg (35*b*) in the side where the torsion spring 35 is bent.

Rotation of the operation handle 2 in the right direction in FIG. 18(*a*) from the normal position of the operation handle 2 is regulated not to go further when the operating section (2A) abuts against the projecting piece 9. Since the operation handle 2 does not move to the position where the end of the collar portion (2*c*) of the operation handle 2 abuts against the inner surface of the opening 32 in the rotational direction, the operation handle 3 does not rotate together.

When the operation handles 2, 3 are rotated as described above, one movable contact (37A) of movable contact members 37 attached to the holes (31*a*, 31*b*) of the operation handle 3 generates a switch output of shorting or parting between the stationary contacts (22*a*1, 22*a*2, 22*a*3) and the stationary contacts (22*c* 1, 22*c*2) of the stationary contact section (16A) in accordance with the rotational angle of the operation handle 3, and the other movable contact (37B) generates a switch output of shorting or parting between the stationary contacts (23*a*1, 23*a*2, 23*a*3, 23*a*4) and the stationary contacts (23*c*1, 23*c*2) of the stationary contact section (16B).

At the same time, in the operation handle 2, one movable contact (37A) of the movable contact member 37 attached to the hole (37*c*) generates a switch output of shorting or parting between the stationary contacts (22*a*1, 22*a*2, 22*a*3) and the stationary contacts (22*c* 1, 22*c*2) of the stationary contact section (16A) in accordance with the rotational angle of the operation handle 2, and the other movable contact (37B) exposed from the thick portion (2*d*) fitted in the opening window (3*d*) of the operation handle 3 generates a switch output of shorting or parting between the stationary contacts (23*a*1, 23*a*2, 23*a*3, 23*a*4) and the stationary contacts (23*c*1, 23*c*2) of the stationary contact section (16B). Further, the movable contact (37A) attached to the hole (31*d*) generates a switch output of shorting or parting between the stationary contact (22*b* 1) and the stationary contacts (22*c*1, 22*c*2) of the stationary contact section (16A), and the movable contact (37B) generates a switch output of shorting or parting between the stationary contact (23*b*1) and the stationary contacts (23*c*1, 23*c*2, 23*c*3) of the stationary contact section (16B).

These switch outputs are outputted to the external circuit from the connector section 5 formed of the output terminal groups 4. Then, the external circuit determines the combination of the switch outputs, so that the position of the shift lever connected to the operation handles 2, 3 through the interlocking mechanism can be detected.

Incidentally, reference numeral 40 in FIG. 2(*a*) designates a film-like dust protective sheet attached to an outside of the collar portion (2*c*) of the operation handle 2. Although the example in which the stationary contacts are disposed at both sides of the operation handle has been explained, the present invention can be applied to a rotary switch in which the stationary contact is disposed at only one side of the operation handle, and the structures of the circuits are not limited to those in the embodiment.

According to the embodiment of the present invention, in the rotary switch in which the stationary contacts arranged in the two arc lines are held by the movable member rotating concentrically with the arc such that the movable contacts urged to the stationary contact sides short or part between the stationary contacts, the contact surfaces of the stationary contacts constitute rough surfaces having minute zigzagged ridges. Therefore, the rough surfaces can hold the oil, to thereby maintain the lubricity of the oil. Accordingly, even if the movable contacts slide along the contact surfaces, or even if the movable contacts slide along the resin ribs, the constituent members are prevented from being worn out, resulting in decreasing the trouble due to the metal powders and resin powders. Moreover, in case the movable contact slides and make contact with the contact surface of the stationary contact, the oil film can be easily cut by the rough surface when the movable contact 37 makes contact with the contact surface, to thereby achieve the stable contact.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A switch comprising:

at least one stationary contact;

at least one movable contact slidable on said at least one stationary contact and configured to be electrically connected to and disconnected from said at least one stationary contact;

lubricant provided between said at least one stationary contact and said at least one movable contact;

said at least one stationary contact having a contact surface which is configured to contact said at least one movable contact, said contact surface having zigzagged ridges which are so dimensioned such that the contact surface is able to retain the lubricant and to be electrically connected to said at least one movable contact;

a pressing unit configured to press said at least one movable contact toward said at least one stationary contact; and an electrical insulator projecting from said at least one stationary contact and configured to prevent said at least one movable contact from electrically contacting said at least one stationary contact.

2. A switch according to claim 1, wherein a maximum height of the zigzagged ridges is at least 2 $\mu$m and at most 8 $\mu$m.

3. A switch according to claim 1, wherein said at least one stationary contact comprises first and second stationary contacts and wherein said at least one movable contact is configured to electrically connect and disconnect said first and second stationary contacts.

4. A switch according to claim 1, wherein said lubricant is lubricating oil.

5. A switch according to claim 1, wherein said at least one movable contact is rotatable to slide on said at least one stationary contact.

6. A switch according to claim 5, wherein said at least one stationary contact extends along an arc.

7. A switch according to claim 1, wherein said at least one movable contact has a tip end which is configured to slide on said at least one stationary contact and which has a rounded cross-section taken along a sliding direction of said at least one movable contact.

8. A switch according to claim 1, wherein said at least one stationary contact comprises first and second stationary contacts which are provided opposite sides with respect to said at least one movable contact, respectively.

9. A switch according to claim 1, wherein said zigzagged ridges are made by blowing particles to said contact surface.

10. A switch according to claim 1, wherein said zigzagged ridges are made by grinding said contact surface using particles.

11. A switch according to claim 1, wherein said at least one movable contact has a surface which is configured to contact said contact surface of said at least one stationary contact and which does not have a rough surface.

12. A switch comprising:

at least one stationary contact;

movable contact means for sliding on said at least one stationary contact and being electrically connected to and disconnected from said at least one stationary contact;

lubricating means for lubricating between said at least one stationary contact and said movable contact means;

said at least one stationary contact having a contact surface which is configured to contact said movable contact means, said contact surface having zigzagged ridges which are so dimensioned such that the contact surface is able to retain the lubricating means and to be electrically connected to said movable contact means;

pressing means for pressing said at least one movable contact means toward said at least one stationary contact; and electrical insulation means projecting from said at least one stationary contact for preventing said at least one movable contact means from electrically contacting said at least one stationary contact.

13. A switch comprising:

at least one stationary contact;

at least one movable contact slidable on said at least one stationary contact and configured to be electrically connected to and disconnected from said at least one stationary contact;

lubricant provided between said at least one stationary contact and said at least one movable contact;

either one of said at least one stationary contact or said at least one movable contact having a contact surface which is configured to contact another of said at least one stationary contact or said at least one movable contact, said contact surface having zigzagged ridges which are so dimensioned such that the contact surface is able to retain the lubricant and to be electrically connected to said another of said at least one stationary contact or said at least one movable contact;

a pressing unit configured to press said at least one movable contact toward said at least one stationary contact; and an electrical insulator projecting from said at least one stationary contact and configured to prevent said at least one movable contact from electrically contacting said at least one stationary contact.

14. A switch comprising:

at least one stationary contact;

at least one movable contact slidable on said at least one stationary contact and configured to be electrically connected to and disconnected from said at least one stationary contact;

lubricant provided between said at least one stationary contact and said at least one movable contact;

said at least one stationary contact having a contact surface which is configured to contact said at least one movable contact, said contact surface having zigzagged ridges, a maximum height of the zigzagged ridges being at least 2 $\mu$m and at most 8 $\mu$m;

a pressing unit configured to press said at least one movable contact toward said at least one stationary contact; and an electrical insulator projecting from said at least one stationary contact and configured to prevent said at least one movable contact from electrically contacting said at least one stationary contact.

15. A switch comprising:

at least one stationary contact;

at least one movable contact slidable on said at least one stationary contact and configured to be electrically connected to and disconnected from said at least one stationary contact;

lubricant provided between said at least one stationary contact and said at least one movable contact;

said at least one stationary contact having a contact surface which is configured to contact said at least one movable contact, said contact surface having zigzagged ridges which are made by blowing particles to said contact surface or by grinding said contact surface using particles;

a pressing unit configured to press said at least one movable contact toward said at least one stationary contact; and an electrical insulator projecting from said at least one stationary contact and configured to prevent said at least one movable contact from electrically contacting said at least one stationary contact.

* * * * *